US011045053B2

(12) United States Patent
Fauconnier

(10) Patent No.: US 11,045,053 B2
(45) Date of Patent: Jun. 29, 2021

(54) DEVICE FOR EXPERIENTIALLY DISPENSING A COSMETIC PRODUCT

(71) Applicant: Sebastien Fauconnier, Neuvy Saint se-Pulchre (FR)

(72) Inventor: Sebastien Fauconnier, Neuvy Saint se-Pulchre (FR)

( * ) Notice: Subject to any disclaimer, the term of this patent is extended or adjusted under 35 U.S.C. 154(b) by 0 days.

(21) Appl. No.: 16/464,129

(22) PCT Filed: Nov. 21, 2017

(86) PCT No.: PCT/FR2017/053186
§ 371 (c)(1),
(2) Date: May 24, 2019

(87) PCT Pub. No.: WO2018/096250
PCT Pub. Date: May 31, 2018

(65) Prior Publication Data

US 2019/0387930 A1 Dec. 26, 2019

(30) Foreign Application Priority Data

Nov. 25, 2016 (FR) ..... 1661492

(51) Int. Cl.
*A47K 5/12* (2006.01)
*A45D 34/00* (2006.01)

(52) U.S. Cl.
CPC ..... *A47K 5/1217* (2013.01); *A45D 34/00* (2013.01); *A45D 2034/005* (2013.01);
(Continued)

(58) Field of Classification Search
CPC ..... A47K 5/1217; A47K 2210/00; A45D 2034/005; A45D 34/00; A45D 2200/055; A45D 2200/057; A45D 2200/155
(Continued)

(56) References Cited

U.S. PATENT DOCUMENTS 928,059 A * 7/1909 Lippstadt ..... B05B 11/3001 222/321.9
2,560,681 A * 7/1951 Berkowitz ..... A45D 34/00 239/55

(Continued)

FOREIGN PATENT DOCUMENTS

EP 1671568 A2 6/2006
KR 20160104415 A 9/2016

(Continued)

OTHER PUBLICATIONS

English translation of Written Opinion of the International Searching Authority dated Jun. 25, 2019 for International Application No. PCT/FR2017/053622, filed Dec. 15, 2017.

(Continued)

*Primary Examiner* — J C Jacyna
(74) *Attorney, Agent, or Firm* — David D. Brush; Westman, Champlin & Koehler, P.A.

(57) ABSTRACT

A device for dispensing cosmetic product. The device includes: a dispensing nozzle; a first mechanism for dispensing a dose of cosmetic product through the dispensing nozzle, from a cosmetic preparation capsule, ready to be dispensed; a second dispensing mechanism for dispensing, through the air, an aromatherapeutic composition; a receiver for receiving disposable capsules; and electronic elements, common to triggering the dispensing mechanisms.

10 Claims, 4 Drawing Sheets

(52) U.S. Cl.
CPC .. *A45D 2200/055* (2013.01); *A45D 2200/155* (2013.01); *A47K 2210/00* (2013.01)

(58) Field of Classification Search
USPC ..... 222/78
See application file for complete search history.

(56) References Cited

U.S. PATENT DOCUMENTS 3,419,188 A * 12/1968 Matchett ..... A47K 5/1217 222/52
5,367,716 A * 11/1994 Huang ..... E03D 9/031 4/222
5,727,579 A * 3/1998 Chardack ..... A47K 10/485 134/102.3
6,610,254 B1 * 8/2003 Furner ..... A01M 1/2033 222/183
7,025,227 B2 * 4/2006 Oliver ..... A47K 5/1217 222/180
7,137,534 B2 * 11/2006 Patel ..... A61L 9/12 222/192
7,458,523 B2 * 12/2008 Hyslop ..... E03C 1/0404 239/67
9,032,565 B2 * 5/2015 Loeck ..... E03C 1/057 4/623
9,051,085 B2 * 6/2015 Withers ..... B65D 25/20
2002/0030116 A1 * 3/2002 Brown ..... B05B 11/3074 239/59
2006/0124662 A1 * 6/2006 Reynolds ..... B41J 2/17506 222/23
2007/0213877 A1 * 9/2007 Hart ..... G07C 9/22 700/282
2008/0143214 A1 * 6/2008 McNamara ..... A45D 40/00 310/318
2009/0140004 A1 * 6/2009 Scorgie ..... A47K 5/1217 222/52
2011/0056991 A1 * 3/2011 Brown ..... A47K 5/1202 222/181.3
2011/0303695 A1 * 12/2011 Fern ..... A61B 90/80 222/52
2012/0112914 A1 * 5/2012 Wegelin ..... G08B 23/00 340/573.1
2015/0004066 A1 * 1/2015 Leon ..... A45D 34/02 422/125
2015/0101121 A1 * 4/2015 Burgo, Sr. ..... E03C 1/0404 4/668
2015/0273513 A1 * 10/2015 Buckalter ..... A47K 5/1217 222/146.2
2018/0103807 A1 * 4/2018 Burgo, Sr. ..... E03C 1/046

FOREIGN PATENT DOCUMENTS

WO 9420407 A1 9/1994
WO 2006134314 A1 12/2006

OTHER PUBLICATIONS

International Search Report dated Jan. 29, 2018 for International Application No. PCT/FR2017/053186, filed Nov. 21, 2017.
Written Opinion of the International Searching Authority dated Jan. 29, 2018 for International Application No. PCT/FR2017/053186, filed Nov. 21, 2017.

* cited by examiner

DEVICE FOR EXPERIENTIALLY DISPENSING A COSMETIC PRODUCT

CROSS-REFERENCE TO RELATED APPLICATIONS

This Application is a Section 371 National Stage Application of International Application No. PCT/FR2017/053186, filed Nov. 21, 2017, the content of which is incorporated herein by reference in its entirety, and published as WO 2018/096250 on May 31, 2018, not in English.

FIELD OF THE DISCLOSURE

The field of the invention is that of designing and producing devices for dispensing cosmetic product. More specifically, the invention relates to a dispenser capable of optimising the conditions of dispensing and applying a cosmetic product.

BACKGROUND OF THE DISCLOSURE

In the field of the invention, liquid or semi-liquid cosmetic product dispensers are known. For example, soap dispensers which are refilled periodically with a product reserve, ready to be dispensed.

Such soap dispensers are in particular described in the patent documents published under numbers EP1671568 and WO2006/134314.

These dispensers can be automated and provided with a presence sensor which makes it possible to trigger the dispensing of a dose of soap when a person positions their hand under a dispensing nozzle.

Such dispensers simplify the dispensing of doses of product, thanks to this contactless triggering.

Also, appliances for formulating and dispensing a cosmetic preparation are known, intended to be installed directly on individuals.

This type of appliance comprises means for receiving ingredient capsules, to formulate a cosmetic preparation. The appliance thus has a stock of ingredients which can be renewed by inserting new capsules.

Such an appliance makes it possible, according to specific parameters (use sought for the cosmetic preparation, etc.) and data on the user (age, sex, skin type, etc.), to produce a specific and instantaneous formulation of a cosmetic preparation. This instantaneous cosmetic preparation is thus deposited on a support, of which the user can hold to carry out a cosmetic treatment.

This appliance for formulating and dispensing a cosmetic preparation makes it possible to personalise the cosmetic product dispensed according to the person for whom it is intended. The preparation of this personalised treatment is also simplified.

Such a formulation and dispensing appliance is, however, complex and expensive.

In addition, in a manner which is comparable to a dispenser using a product reserve, ready to be dispensed, the conditions for applying the treatment created by this formulation and dispensing appliance are not personalised. Indeed, these dispensers are dedicated to dispensing, and in each case, the user obtains, simply, a dose of product to be applied.

The soap dispenser described in the patent document published under number WO94/20407 comprises a fragrance reserve. Actuating a lever makes it possible to obtain a dose of soap and to trigger an electrical member, complementary to the fragrance reserve to strengthen the dispensing of the fragrance. Intended to be installed in toilets, this device makes it possible to make the use thereof more pleasant. This device, however, only makes it possible to avoid unpleasant smells for the users of toilets.

There is thus a need, which aims to improve the circumstances of applying a dose of cosmetic product obtained by way of a dispenser.

This need is particularly marked for babies, for whom a cosmetic product must be applied by their mothers. Indeed, applying a product can be disturbing and even unpleasant for a child. It is thus necessary to avoid disturbing the child and/or to be able to calm them.

Improving the application circumstances can also be useful for pregnant women in the scope of applying a dose of cosmetic product on their stomach.

From the prior art, also the devices described in the documents published under the numbers US2011/303695 and KR20160104415 are known.

SUMMARY

The invention in particular aims to overcome this need of the prior art.

More specifically, the invention aims to propose a device for dispensing doses of a cosmetic product which makes it possible to create a specific ambience during the application of the cosmetic product.

The invention also aims to propose such a device, which is simple to use.

These aims, as well as others which will appear below, are achieved thanks to the invention, which aims for a device for dispensing cosmetic product comprising:

- a dispensing nozzle;
- a mechanism for dispensing a dose of cosmetic product through the dispensing nozzle, from a cosmetic preparation capsule, ready to be dispensed;

characterised in that it furthermore integrates means for dispensing through the air, an aromatherapeutic composition, and in that it comprises:

- means for receiving disposable cosmetic preparation capsules, ready to be dispensed and/or aromatherapeutic composition for dispensing through the air, the receiving means comprising a first housing (40) for the cosmetic product capsules, and a second housing (41) for aromatherapeutic composition capsules;
- electronic means common to triggering the dispensing mechanism and the dispensing means;
- means for reading identification codes, likely to be carried by capsules inserted in the receiving means;
- electronic means for managing the dispensing of cosmetic product and of dispensing through the air of an aromatherapeutic composition, the electronic management means being coupled with the means for reading identification codes.

Such a dispensing device according to the invention makes it possible to optimise the conditions for dispensing a dose of cosmetic product, as well as the conditions for applying the dose of cosmetic product.

Indeed, thanks to the disposable capsule system, it is easy to prepare the device, such that it is ready to dispense a dose.

Also, thanks to the electronic means common to triggering the dispensing mechanism and the dispensing means, the user can receive a dose of cosmetic product and proceed with a treatment (of the face or of the body) by applying the dose of cosmetic product dispensed, this together with the dispensing through the air of an aromatherapeutic preparation.

These electronic means can in particular synchronise the dispensing through the air of the aromatherapeutic composition with the dispensing of the dose of the cosmetic preparation ready to be dispensed, for example, by following a predefined programme, or programme specific to said cosmetic preparation selected by the user.

For example, the cosmetic product can correspond to the following treatments:

baby changing treatment;

hydration treatment;

relaxation treatment, etc.

The aromatherapeutic composition can itself correspond to:

bronchiolitis treatment;

relaxation treatment, etc.

According to an example of applying the dispensing device according to the invention, a rich sensorial experience can be obtained thanks to the dispensing of an aromatherapeutic composition having relaxing properties, combined with the performing of a massage, the massage being performed using a massage oil dispensed by the dispensing means of the device. This experience is thus optimised, thanks to the device, which makes it possible to simply obtain good conditions for performing the massage.

The user can thus benefit from a rich sensorial experience particularly simply. The dispensing device thus makes it possible to obtain a specific experiential moment.

Using the dispensing device according to the invention by a mother wishing to apply a cosmetic product on her baby illustrates the simplicity and the capacity of the device to create a moment of experiential application. Indeed, applying a cosmetic product using the device makes it possible to automatically and in a synchronised manner, induce optimised and beneficial application conditions.

More specifically, the device makes it possible for the dispensing of relaxing essential oils, which would be capable of calming a baby during a treatment. Thanks to the reading means and to the electronic management means, inserting capsules in the device makes it possible to automatically generate specific dispensing and/or diffusion parameters relative to what is contained in the capsules. In this manner, the configuration is optimised according to the capsules and can be achieved simply and transparently for the user.

More specifically, according to an application example, during the insertion of a cosmetic product capsule and a capsule of an aromatherapeutic composition, the reading means read the identification codes carried by each of the capsules. This reading of the identification codes makes it possible for the means for electronically managing the dispensing of cosmetic product and the dispensing through the air of the aromatherapeutic composition to determine the manner wherein the dispensing and the diffusion must be carried out.

Identifying the capsules, then managing the dispensing and the diffusion according to the capsules inserted, make it possible for the electronic means common to triggering the dispensing mechanism and the dispensing means to best operate an action, without necessarily another intervention of the user, to start the device following the insertion of the capsules.

This management of both the dispensing and the diffusion, according to the capsules inserted, is intended to make it possible to create a sensorial experience designed in an optimised manner.

Advantageously, the device comprises wireless communication electronic means.

These wireless communication electronic means make it possible for the device to be operated remotely, for example using a smartphone or an electronic tablet. These wireless communication electronic means also make it possible for such smartphones or electronic tablets to display information relating to the use, even of the device (maintenance, capsule capacity, etc.), or also to display usage advice relating to the type of cosmetic product or aromatherapeutic composition inserted inside the device.

For example, in cooperation with the means for reading identification codes, inserting a cosmetic product capsule and the switching on of the device can lead to the displaying, on a smartphone, of a demonstration video, detailing the manner in which the treatment must be applied.

According to an advantageous characteristic, the dispensing mechanism comprises a circuit for heating the dose of cosmetic product to be dispensed.

Such a heating circuit makes it possible to bring the dose of cosmetic product to an optimal application temperature (in particular, 37° C., and this, in particular to avoid a difference in temperature between the cosmetic product and the skin on which this treatment will be applied).

Preferably, the device comprises an outer surface zone, intended to form a hand warmer, and means for heating the outer surface zone.

Such a hand warmer makes it possible to bring the hands to the body temperature, which makes it possible to optimise the conditions for applying a dose of cosmetic product. In the scope of a cold environment or people who have cold hands, this hand warmer is particularly effective.

Such a hand warmer cooperates in a synergistic manner with the circuit for heating the dispensing mechanism.

Preferably, the hand warmer comprises at least one second presence sensor.

The hand warmer is thus triggered particularly simply.

The second presence sensor capable of triggering the hand warmer is of the "contactless" type or preferably "contact" type.

Advantageously, the hand warmer has at least two presence sensors distributed on either side of the outer surface zone.

Thanks to these two second presence sensors, the hand warmer is not triggered randomly if one single presence sensor is activated.

Preferably, the device comprises at least one first presence sensor positioned in the proximity of the dispensing nozzle, the first presence sensor being capable of triggering the dispensing mechanism during the presentation of a hand in front of the first presence sensor.

The first presence sensor is capable of triggering the dispensing mechanism of the "contact" type, or preferably, of the "contactless" type.

According to a preferred embodiment, the device has a nozzle for dispensing the cosmetic product taking the shape of a swan's neck having an end extending towards the bottom, the dispensing nozzle being located at the end of the swan's neck, and the first presence sensor is of the contactless type and has a detection zone located in a cavity formed by the swan's neck, the cavity being located above a horizontal plane wherein the dispensing nozzle falls.

Thanks to this embodiment, the dispensing of a dose of cosmetic product is improved.

Indeed, this design forces the user to position their hand below the end of the swan's neck while lowering the hand so as to have the palm ready to receive the product, with the fingers which enter into the cavity of the swan's neck, in the detection zone of the first presence sensor. In this manner, the hand assumes a particularly suitable shape for receiving the dose of cosmetic product.

In the case where the cosmetic product ready to be dispensed is particularly fluid (oil, milk, etc.), this embodiment of the dispenser (dispensing nozzle in the shape of a swan's neck, detection zone located in the cavity formed by the swan's neck, etc.) makes it possible to ensure that the dose will be correctly dispensed and collected in the cavity of the hand of the user.

According to a solution which can be considered, the device comprises at least one phototherapeutic LED.

According to another solution which can be considered, the device comprises at least one speaker.

According to these solutions, the sensorial experience permitted by the device is even more optimised. Indeed, the synchronisation of the different properties of the device contributes to the creation of a specific ambience, particularly simple to implement.

The speaker can, for example, diffuse sounds suitable for a baby for the purpose of calming them, or also music selected by the user.

The invention also has, as the second aim, a device for dispensing cosmetic product comprising:

a dispensing nozzle;

a mechanism for dispensing a dose of cosmetic product through the dispensing nozzle, from a cosmetic preparation capsule ready to be dispensed;

at least one first presence sensor positioned in the proximity of the dispensing nozzle, the first presence sensor being capable of triggering the dispensing mechanism during the presentation of a hand in front of the first presence sensor;

means for receiving disposable cosmetic preparation capsules, ready to be dispensed;

characterised in that it further comprises an outer surface zone intended to form a hand warmer, and means for heating the outer surface zone.

The hand warmer makes it possible to bring the hands of a person to the body temperature which makes it possible to optimise the conditions for applying a dose of cosmetic product. In the scope of a cold environment or people who have cold hands, this hand warmer is particularly effective.

For example, for performing a massage, the person who performs the massage can heat their hands using the hand warmer, then directly put a hand in the proximity of the first presence sensor to receive a dose of cosmetic product. In this manner, the massage performed is comfortable and pleasant, while being particularly easy to perform by the person performing this massage.

The invention also has, as the third aim, a device for dispensing cosmetic product comprising:

a dispensing nozzle;

a mechanism for dispensing a dose of cosmetic product through the dispensing nozzle, from a cosmetic preparation capsule, ready to be dispensed;

at least one first presence sensor positioned in the proximity of the dispensing nozzle, the first presence sensor being capable of triggering the dispensing nozzle during the presentation of a hand in front of the first presence sensor;

means for receiving disposable cosmetic preparation capsules, ready to be dispensed, characterised in that it has a nozzle for dispensing the cosmetic product taking the shape of a swan's neck having an end extending towards the bottom, the dispensing nozzle being located at the end of the swan's neck, and in that the first presence sensor is of the contactless type, and forms a detection space located in a cavity formed by the swan's neck, the cavity being located above a horizontal plane wherein the dispensing nozzle falls.

Thanks to this third aim of the invention, the dispensing of a dose of cosmetic product is improved.

Indeed, this design forces the user to position their hand below the end of the swan's neck, while lowering the hand so as to have the palm ready to receive the product, with the fingers which enter into the cavity of the swan's neck, in the zone for detecting the first presence sensor. In this manner, the hand assumes a particularly suitable shape for receiving the dose of cosmetic product.

In the case where the cosmetic product ready to be dispensed is particularly fluid (oil, milk, etc.), this embodiment of the dispenser (dispensing nozzle in the shape of a swan's neck, detection zone located in the cavity formed by the swan's neck, etc.) makes it possible to ensure that the dose will be correctly dispensed and collected in the cavity of the hand of the user.

The second aim and the third aim of the invention can integrate all or some of the characteristics of the first aim of the invention.

BRIEF DESCRIPTION OF THE DRAWINGS

Other characteristics and advantages of the invention will appear more clearly upon reading the following description of a preferable embodiment of the invention, given as an illustrative and non-limiting example, and appended drawings, among which.

DETAILED DESCRIPTION OF ILLUSTRATIVE EMBODIMENTS

In reference to FIGS. 1 to 5, the dispensing device 1 comprises a shell 10 taking, in the bottom portion thereof, the shape of a base, and, in the high portion thereof, the shape of a swan's neck.

Figure 3:
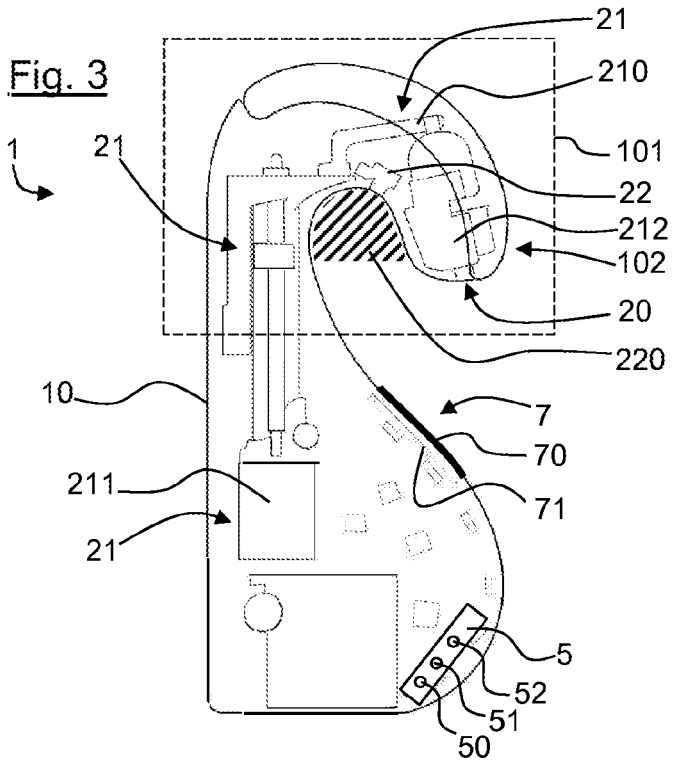
FIGS. 3 and 4 are side views of the dispensing device.
Figure 4:
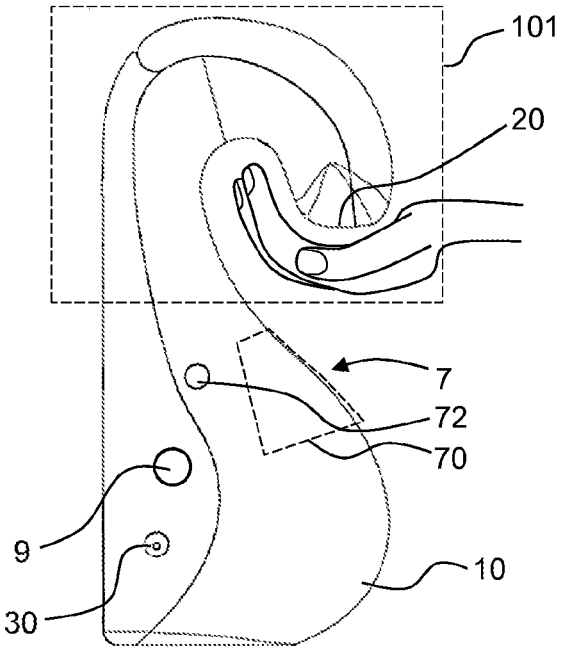

More specifically, and such as appears in FIGS. 3 and 4, the device has, in the high portion thereof, a nozzle for dispensing 101 cosmetic product which takes the shape of a swan's neck which has an end 102 extending towards the bottom.

Figure 1:
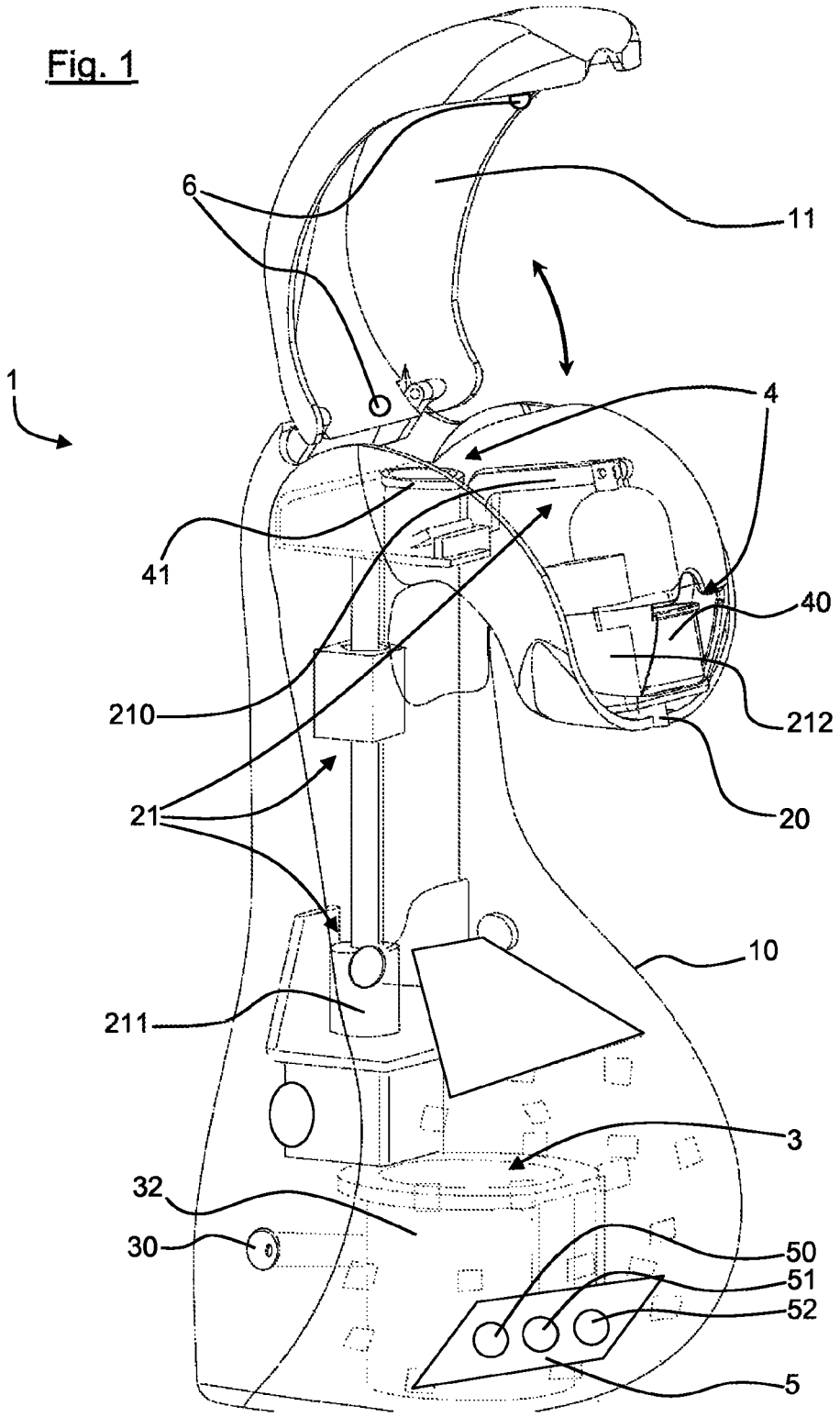
FIG. 1 is a schematic representation of the dispensing device according to the invention, according to a perspective view and with the open cap thereof.

In reference to FIG. 1, the dispensing device comprises:

a receiver 4 for receiving disposable cosmetic preparation capsules, ready to be dispensed and/or aromatherapeutic composition for dispensing through the air;

a dispensing mechanism 3 for dispensing through the air, an aromatherapeutic composition located in one of the capsules;

a dispensing nozzle 20;

a mechanism for dispensing 21 a dose of cosmetic product by way of the dispensing nozzle, from one of the capsules.

The shell 10 of the dispensing device comprises a hinged cap 11. This cap 11 is represented in an open position in FIG. 1. In the open position of the cap, the receiver 4 for receiving disposable capsules is accessible.

In reference to FIG. 1, the receiver 4 comprises a first housing 40 (located in the proximity of the end of the swan's neck) for cosmetic product capsules, and a second housing 41 for aromatherapeutic composition capsules.

According to the present embodiment, the capsules intended to be inserted into the machine carry identification codes. Such as illustrated by FIG. 1, the device 1 comprises means for reading 6 these identification codes when the capsules are inserted into the receiver 4. These reading means 6, in particular comprising sensors, are located on the cap and come opposite the capsules inserted into the first housing 40 and in the second housing 41, once the cap is closed.

The identification codes of the capsules can, for example, be barcodes, single-use flash codes, or also NFC codes.

Such as illustrated by FIGS. 3 and 4, the device also comprises at least one first presence sensor 22 of the "contactless" type which is positioned in the proximity of the dispensing nozzle 20. This first presence sensor makes it possible to trigger the dispensing mechanism during the presentation of a hand, or of the portion of a hand in front of the presence sensor.

Still according to FIGS. 3 and 4, the dispensing nozzle is located at the end of the swan's neck, and the first "contactless" presence sensor 22 is designed and configured to form a detection space 220 which is located in a cavity formed by the shape of the swan's neck, this cavity being located above a horizontal plane wherein the dispensing nozzle falls.

Such as illustrated in FIG. 4, this specific shape of the dispensing nozzle 101 and the relative placements of the first presence sensor and of the dispensing nozzle 20 forces a user who seeks to have a dose of cosmetic product to bend their hand such that their fingers pass into the detection space. Thanks to this configuration, the user tends to have their hand in an optimised manner, to receive the dose of cosmetic product and thus avoid the cosmetic product pouring to the side of the palm of their hand.

In other words, this first contactless presence sensor is positioned withdrawn and above the dispensing nozzle with respect to a direction for introducing a hand to collect a dose of cosmetic product, while being oriented opposite said dispensing nozzle. This first presence sensor does not trigger a dispensing if a person only positions a portion of their hand just below the dispensing nozzle.

According to the present embodiment illustrated by FIGS. 1 and 3, the mechanism for dispensing 21 a dose of cosmetic product comprises:

a piston mechanism 210 actuated by a motor 211;

a circuit for heating 212 the dose to be dispensed.

The heating circuit makes it possible to bring a dose of cosmetic product to be dispensed at body temperature.

The dispensing mechanism for dispensing 3 through the air, an aromatherapeutic composition are of the ultrasound type.

In reference to FIG. 1, during the insertion of an aromatherapeutic composition capsule into the second housing 41 of the receiver 4, a needle perforates the capsule to start the dispensingmechanism 3. During a triggering of the dispensing mechanism 3, droplets of the aromatherapeutic composition flow from the aromatherapeutic composition to into a block 32 where they are suspended in the air, in the form of smoke, using an ultrasound membrane. Ventilators 30 make it possible to create an air flow to increase the dispensing of the aromatherapeutic composition suspended in the air.

In reference to FIGS. 1 and 3, the device comprises an electronic board 5. This electronic board groups together:

electronic elements common to triggering 50 the dispensing mechanism 21 and the dispensing mechanism 3;

electronic elements for managing 51 the dispensing of cosmetic product and the dispensing through the air of an aromatherapeutic composition;

wireless communication electronic device 52.

Thanks to the electronic elements common to triggering the dispensing of a dose of cosmetic product and the dispensing through the air of an aromatherapeutic composition can be synchronised, or produced complementarily to obtain, particularly easily, a satisfactory sensorial experience.

The management electronics are coupled with the means for reading 6 identification codes. The management electronics make it possible to adapt the dispensing of cosmetic product and the dispensing through the air of an aromatherapeutic composition to the products and compositions of the capsules inserted into the device.

Indeed, the identification codes make it possible for the configuration means to integrate, for example, the capacity of the capsules (6 ml, 12 ml, etc.), and the number of doses available in the capsules. According to the identification codes, other parameters of the device according to the invention can be modified, such as the heating temperature of the dose of cosmetic product to be dispensed.

A safety unit, capable of locking the device, can be installed to prevent using non-compliant cosmetic products and aromatherapeutic compositions. The identification codes are thus used to unlock the device.

The wireless communication electronic device 52 makes it possible for the dispensing device, according to the invention, to interact with other electronic devices.

For example, the dispensing device can be paired with a smartphone or an electronic tablet to control the dispensing device remotely, or to receive information from the device.

The smartphone or the electronic tablet can be provided with an application dedicated to the dispensing device.

According to a practical example, the application can display combinations of aromatherapeutic compositions and cosmetic products to be used in synergy.

During the insertion of the relative capsules into the dispensing device, the identification codes make it possible to ensure that the correct products have been inserted into the receiver of the device, and the wireless communication electronic device can thus send an item of information relating to these products. The application can thus automatically display a demonstration video explaining the method to follow to correctly apply the treatments.

The application can also manage stocks of capsules by indexing the capsules used, then make it possible to place a new order for capsules by considering what has been used.

Figure 5:
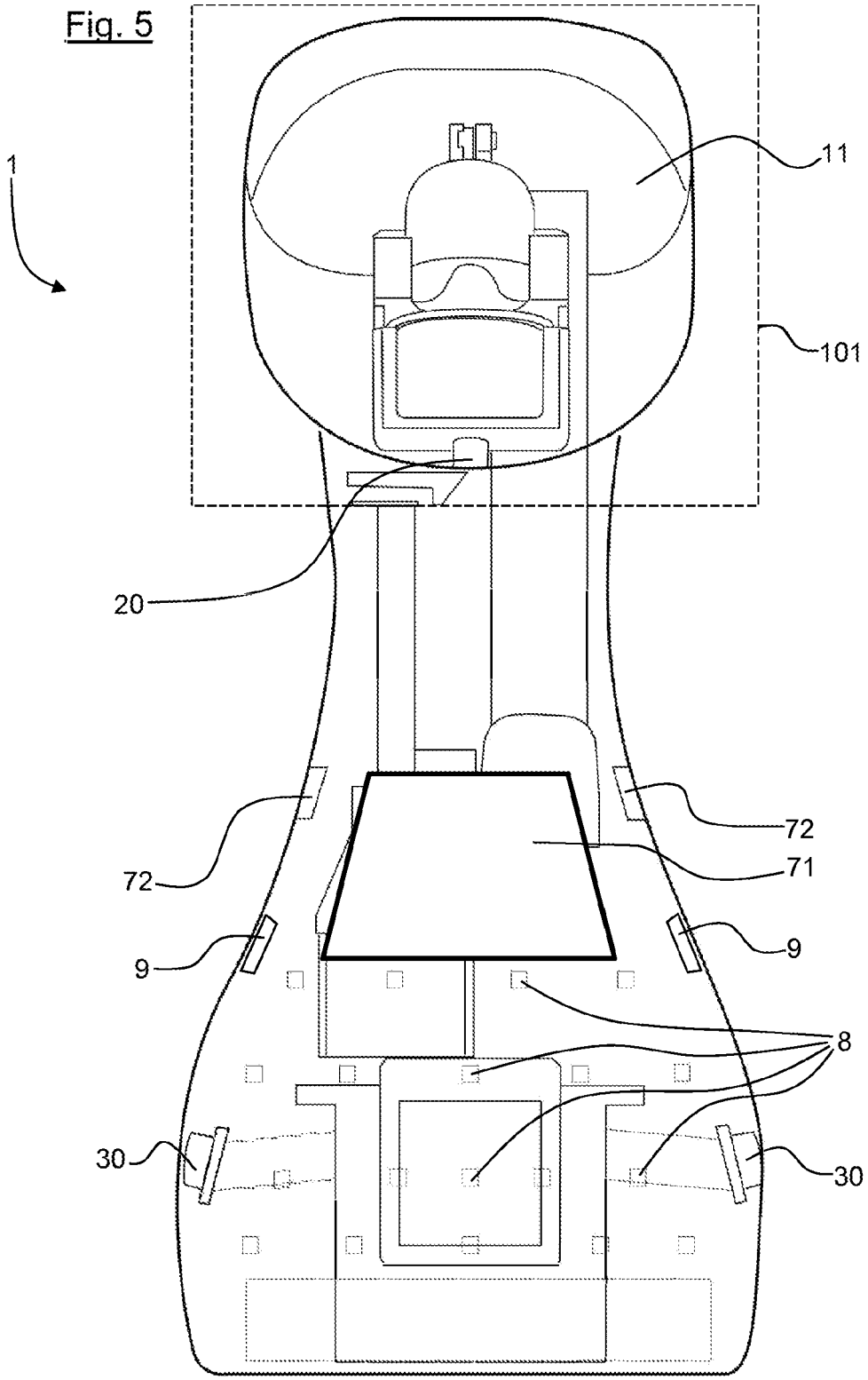
FIG. 5 is a schematic representation of the dispensing device according to the invention, according to a front view.

Such as illustrated by FIGS. 2 to 5, the device 1 comprises:

an outer surface zone 70 intended to form a hand warmer 7;

a heater for heating 71 the outer surface zone (represented in FIGS. 3 and 5).

This outer surface zone 70 is located on the base of the device and more specifically on the front face of this base.

The hand warmer 7 has two second presence sensors 72 of the "contact" type which are distributed on either side of the outer surface zone.

Thanks to this distribution, the hand warmer tends to only be triggered if a person correctly positions their hand on the outer surface zone (for example, by positioning the thumb and the index finger of their hand on the presence sensors).

Figure 2:
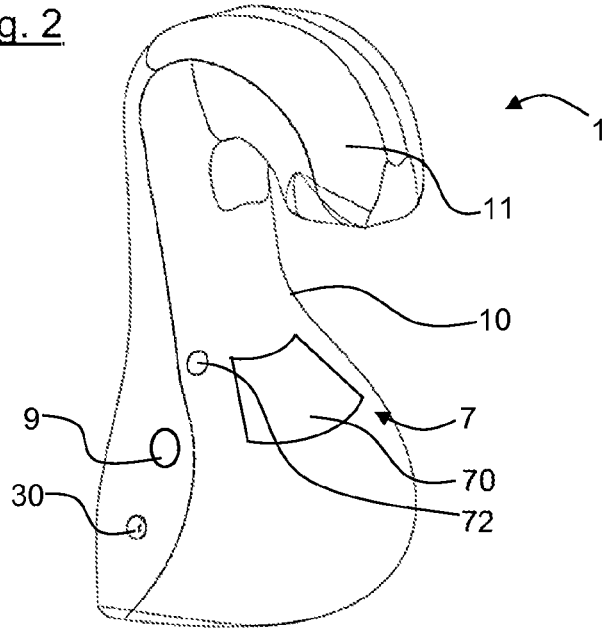
FIG. 2 is a schematic representation of the device according to the invention with the closed cap thereof.

In reference to FIGS. 2, 4 and 5, the device 1 also comprises speakers 9.

The device finally comprises phototherapeutic LEDs 8 (illustrated in FIG. 5).

The phototherapeutic LEDs and the speakers can, for example, be triggered during the production of a specific programme (a massage, for example). The speakers can thus automatically dispense relaxing sounds or music suitable for the type of massage performed. Likewise, according to the massage, the phototherapeutic LEDs can thus follow a specific sequence to optimise the relaxing effect of the massage.

The user can use an electronic tablet on which they have previously installed the information application dedicated to the device, and that it has been paired to the device.

On the application, the user can, for example, select a massage programme that they seek to perform.

In the scope of applying a cosmetic product (a treatment) to a baby by their mother, the application can indicate to the mother, a suitable combination comprising a relaxing aromatherapeutic composition capsule and a cosmetic product capsule, ready to be used.

Following the insertion of the capsules into the device, the latter is automatically configured and a demonstration video can be displayed on the electronic tablet to optimally explain how to perform the treatment.

The mother can thus start the treatment by heating their hand using the hand warmer, by returning the dose of cosmetic product heated to body temperature, then by starting to perform the application, for example, a massage.

During the performance of this treatment, the device according to the present embodiment automatically triggers the dispensing through the air of the aromatherapeutic composition, creates a lighting ambience synchronised with the massage by way of phototherapeutic LEDs and also dispenses relaxing sounds or music, also synchronised with the treatment.

The device thus makes it possible to simply obtain an experiential dispensing and application of a cosmetic product.

It is also conceivable to propose derivative versions of the embodiment which has been described above.

In a first variant and a second variant of the device for dispensing cosmetic product according to the invention, the device comprises:

- a dispensing nozzle;
- a mechanism for dispensing a dose of cosmetic product through the dispensing nozzle, from a cosmetic preparation capsule, ready to be dispensed;
- at least one first presence sensor positioned in the proximity of the dispensing nozzle, the first presence sensor being capable of triggering the dispensing mechanism during the presentation of a hand in front of the first presence sensor;
- a receiver for receiving cosmetic preparation disposable capsules, ready to be dispensed.

In the first embodiment variant, the device also comprises an outer surface zone intended to form a hand warmer, and a heater for heating the outer surface zone.

For the second variant, the device has a nozzle for dispensing the cosmetic product taking the shape of a swan's neck having an end extending towards the bottom, the dispensing nozzle being located at the end of the swan's neck, and the first presence sensor is of the contactless type and forms a detection space located in a cavity formed by the swan's neck, the cavity being located above a horizontal plane, wherein the dispensing nozzle falls.

Although the present disclosure has been described with reference to one or more examples, workers skilled in the art will recognize that changes may be made in form and detail without departing from the scope of the disclosure and/or the appended claims.

The invention claimed is:

1. A device for dispensing cosmetic product, comprising:

- a dispensing nozzle;
- a first dispensing mechanism to dispense a dose of cosmetic product through the dispensing nozzle, from a cosmetic preparation capsule, ready to be dispensed;
- a second dispensing mechanism to dispense, through the air, an aromatherapeutic composition,
- a first housing to receive disposable cosmetic preparation capsules, ready to be dispensed;
- a second housing to receive aromatherapeutic composition capsules containing the aromatherapeutic composition;
- electronic elements, common to triggering the first dispensing mechanism and the second dispensing mechanism;
- reading sensors for reading identification codes, carried by capsules inserted into the first and second housings;
- management electronics configured to manage dispensing of the cosmetic product and dispensing through the air of the aromatherapeutic composition, the management electronics being coupled with the reading sensors so that during the insertion of a cosmetic product capsule and a capsule of an aromatherapeutic composition the reading sensors read the identification codes carried by each of the capsules, allowing the management electronics managing the dispensing of cosmetic product and the dispensing through the air of the aromatherapeutic composition to determine the manner wherein the dispensing and the diffusion must be carried out.

2. The device according to claim 1, further comprising a wireless communication electronic device.

3. The device according to claim 1, wherein the first dispensing mechanism comprises a circuit for heating the dose of the cosmetic product to be dispensed.

4. The device according to claim 1, further comprising at least one first presence sensor positioned in the proximity of the dispensing nozzle, the first presence sensor being capable of triggering the first dispensing mechanism during presentation of a hand in front of the first presence sensor.

5. The device according to claim 4, further comprising a dispensing portion for dispensing the cosmetic product, taking the shape of a swan's neck having an end extending towards a bottom of the dispensing portion, the dispensing nozzle being located at an end of the swan's neck,

- and wherein the first presence sensor is of the contactless type and forms a detection space located in a cavity formed by the swan's neck, the cavity being located above a horizontal plane, wherein the dispensing nozzle is positioned.

6. The device according to claim 1, further comprising an outer surface zone forming a hand warmer, and a heater for heating the outer surface zone.

7. The device according to claim 6, wherein the hand warmer comprises at least one second presence sensor.

8. The device according to claim 7, wherein the hand warmer has at least two second presence sensors distributed on either side of the outer surface zone.

9. The device according to claim 1, further comprising at least one phototherapeutic LED.

10. The device according to claim 1, further comprising at least one speaker.

* * * * *